US005536366A

United States Patent [19]

Marcoccia et al.

[11] Patent Number: 5,536,366

[45] Date of Patent: Jul. 16, 1996

[54] DIGESTER SYSTEM FOR IMPLEMENTING LOW DISSOLVED SOLIDS PROFILING

[75] Inventors: Bruno S. Marcoccia, South Glens Falls; J. Robert Prough, Queensbury; Richard O. Laakso, Queensbury; R. Fred Chasse, Queensbury, all of N.Y.

[73] Assignee: Ahlstrom Machinery Inc., Glens Falls, N.Y.

[21] Appl. No.: 148,269

[22] Filed: Nov. 8, 1993

Related U.S. Application Data

[63] Continuation-in-part of Ser. No. 127,548, Sep. 28, 1993, which is a continuation-in-part of Ser. No. 56,211, May 4, 1993, Pat. No. 5,489,363.

[51] Int. Cl.[6] ..... D21C 7/14

[52] U.S. Cl. ..... 162/43; 162/45; 162/248; 162/251

[58] Field of Search ..... 162/41, 42, 45, 162/43, 248, 249, 251

[56] References Cited

U.S. PATENT DOCUMENTS 3,802,956 4/1974 Backlund ..... 162/19
5,320,247 4/1994 Richardsen et al. ..... 162/42

FOREIGN PATENT DOCUMENTS 407370 1/1991 European Pat. Off. .
476230 3/1992 European Pat. Off. .
WO94/09203 4/1994 WIPO .

OTHER PUBLICATIONS

ITD Publication, "Extended Delign'ification/Modified Cooking of paper pulp", Nov. 1987.

*Primary Examiner*—Donald E. Czaja
*Assistant Examiner*—Dean T. Nguyen
*Attorney, Agent, or Firm*—Nixon & Vanderhye

[57] ABSTRACT

Digester systems for producing paper pulp from comminuted cellulosic fibrous material take into account the level of dissolved organic materials (DOM), such as lignin, hemicellulose, and cellulose, maintaining the DOM level at about 100 g/l throughout the cook (particularly kraft cook). In order to make sure there is sufficient liquid to slurry the material in the feed system of a two vessel system, some liquid is withdrawn from the circulation conduits between the digester and impregnation vessel, cooled, and fed to the feed system. In a vapor phase digester, the level of liquid at the top of the digester is more precisely controlled by circulating some of the withdrawn liquid from a circulatory loop of the digester to the level tank associated with the feed system. An in-line drainer may be provided in the feed system between a make-up liquor pump and a liquid inlet conduit leading to the top of an impregnation vessel. Within the digester, a set of extraction/dilution screens is provided specifically positioned and spaced from each other, and with respect to a reintroduction conduit opening, so that mixing of different DOM concentration liquids is minimized.

13 Claims, 8 Drawing Sheets

DIGESTER SYSTEM FOR IMPLEMENTING LOW DISSOLVED SOLIDS PROFILING

CROSS-REFERENCE TO RELATED APPLICATIONS

This application is a continuation-in-part of application Ser. No. 08/127,548 filed Sep. 28, 1993 (Att. Ref. 10-863), which in turn is a continuation-in-part of application Ser. No. 08/056,211 filed May 4, 1993 (Att. Ref. 10-846) now U. S. Pat. No. 5,489,363 , the disclosures of which are incorporated by reference herein.

BACKGROUND AND SUMMARY 0F THE INVENTION

The parent applications disclose the breakthrough concept of taking care to control the level of dissolved organic materials (DOM)—which mainly comprise dissolved lignin, hemi-cellulose, cellulose, and other materials extracted from wood by the kraft pulping process—in order to increase pulp strength and bleachability, with decreased consumption of effective alkali, and at a lower H factor. The DOM level is typically kept at a concentration of 100 g/1 or less (e.g. about 50 g/1 or less) substantially throughout the cook, the hemi-cellulose level typically being kept at 15 g/1 or less (e.g. about 10 g/1 or less), and the lignin level typically being kept at 50 g/1 or less (e.g. about 25 g/1 or less). This is done by withdrawing high DOM level liquid from an upright digester and/or feed or circulatory loops associated with the digester (typically a continuous digester), and replacing the high DOM level liquid with low effective DOM level liquid. The term "effective DOM" as used in association with the invention means that portion of the DOM that affects pulp strength, H factor, effective alkali consumption, and/or bleachability. Low effective DOM liquid is typically water, substantially DOM free white liquor, washer filtrate, cold blow filtrate, pressure-heat treated black liquor, and combinations thereof.

According to the present invention, various digester systems and components, and methods of treating comminuted cellulosic fibrous material, are provided which facilitate practical implementation of the DOM level control concepts disclosed in the parent applications. According to the present invention, various advantageous results are obtained, some of them by using unexpected techniques, others by using conventional equipment but in new manners.

In pulping systems which control DOM, adding white liquor at numerous points and levels in a continuous digester, and adding low effective DOM dilution liquids too, means that less liquid is available to transport chips during and after impregnation, that is from the high pressure transfer device to the digester. For example, the amount of alkali fed to the feed system in digester systems controlling DOM may be as low as 40–55% (e.g. less than about 55%). In order to accommodate this, liquid is withdrawn from the circulation line from the top of the digester to the bottom of the impregnation vessel, cooled, and fed to the high pressure inlet line for the high pressure transfer device.

That is, according to one aspect of the present invention, a two vessel continuous digester system for digesting cellulosic fibrous material is provided, including the following elements: An impregnation vessel having a top and a bottom, an inlet for cellulosic fibrous material slurry to be digested at the top of the impregnation vessel, and an outlet for slurry from the bottom of the impregnation vessel, and an outlet for recirculating liquid from the top of the impregnation vessel.

A circulatory system for feeding slurry to the top of the impregnation vessel, and receiving recirculating liquid from the top of the impregnation vessel. A continuous digester having a top and a bottom, an inlet for cellulosic fibrous material slurry to be digested at the top of the digester, an outlet for digested pulp at the bottom of the digester, and an outlet for recirculating liquid from the top of the digester. A first conduit extending between the impregnation vessel slurry outlet and the digester slurry inlet, and a second conduit extending between the recirculating liquid outlet at the top of the digester and the bottom of the impregnation vessel. At least one DOM-reducing screen assemblies between the top and bottom of the digester. Means for withdrawing a first portion of the liquid passing through each of the DOM-reducing screen assemblies and passing it to recovery, a second portion of the liquid remaining. Means for adding low effective DOM liquid to each the second portion to provide an augmented second portion; means for adding cooking liquor to at least one of the second portions. Means for recirculating the augmented second portions to the interior of the digester. And, novel according to the invention, means for augmenting the flow of liquid in the circulatory system, comprising means for withdrawing liquid from the second conduit, means for cooling the withdrawn liquid, and means for introducing the cooled withdrawn liquid into the circulatory system.

The circulatory system typically includes a high pressure transfer device and a high pressure pump having an inlet and an outlet, the high pressure pump being connected to the high pressure pump outlet. The means for introducing the cooled withdrawn liquid into the circulatory system comprises means for introducing the cooled withdrawn liquid into a conduit connected to the high pressure pump inlet. The system also preferably further comprises means for adding cooking liquor to the withdrawn liquid, e.g. adding the cooking liquor before the means for cooling the withdrawn liquid. The means for cooling the withdrawn liquid preferably comprises a heat exchanger cooler, or an evaporative cooler.

The digester also preferably includes an extraction screen assembly, and the at least one DOM-reducing screen assemblies comprise a trim screen assembly located adjacent the top of the digester, and a cooking screen assembly disposed between the trim screen assembly and the extraction screen. The digester preferably further includes a wash screen assembly located between the bottom of the digester and the extraction screen assembly, and further comprising means for adding cooking liquor to the wash screen assembly blanked recirculation pipe disposed in the digester at the extraction screen assembly, so that the extraction screen assembly may be readily modified to comprise a recirculating screen assembly.

Alternatively, the digester may further include a combined recirculating and extraction screen assembly adjacent the top of the digester; and the at least one DOM-reducing screen assemblies preferably includes a first screen assembly disposed below the combined recirculating and extraction screen assembly, and a second screen assembly disposed below the first screen assembly. Also provided may be a wash screen assembly located between the bottom of the digester and the second screen assembly, and means for adding cooking liquor to the wash screen assembly.

According to another aspect of the invention, a method utilizing such apparatus may be practiced. The method comprises the following steps: a) At at least one location between the top and bottom of the digester, withdrawing DOM containing liquid from the interior of the digester, splitting the liquid into first and second flows, and passing the first flow to recovery. (b) Adding low DOM containing liquid to the second flow, including white liquor, and recirculating the second flow back to the interior of the digester; and (c) augmenting the flow liquid in the circulatory system by withdrawing liquid from the second conduit, cooling the withdrawn liquid, and introducing the cooled withdrawn liquid into the circulatory system.

Preferably, the circulatory system includes a high pressure transfer device and a high pressure pump having an inlet and an outlet, the outlet being connected to the high pressure transfer device, in which case step (c) is practiced by introducing the cooled withdrawn liquid into a conduit connected to the high pressure pump inlet, and is preferably further practiced by adding white liquor to the withdrawn liquid (e.g. by adding the cooking liquor to the withdrawn liquid before cooling the withdrawn liquid). Typically, the amount of white liquor to the material prior to the digester is about 55% or less of the total amount of white liquor added. The cooling in step (c) may be practiced by heat exchange or evaporative cooling.

The method also typically includes the further steps of withdrawing and recirculating liquid in a wash loop at the bottom of the digester and adding white liquor to the wash loop, and extracting liquid from the digester and passing it to recovery distinct from the wash loop and the first portion of the withdrawn liquid passed to recovery from step (a). Normally steps (a) and (b) are practiced at a plurality of different levels within the digester.

According to the invention, there may also be provided particular means and a procedure for controlling the level of liquid in a vapor (steam) phase digester. Going against conventional wisdom, which is that it is not beneficial to extract liquor shortly after impregnation during kraft cooking, according to this aspect of the invention, an extraction from near the top of the vessel may be led into operative association with the level tank associated with the feed system for the digester assembly, either directly connected to a conduit leading to the level tank in a single vessel vapor phase system, or to the sluice flow of the high pressure transfer device if a two vessel vapor phase system is utilized.

That is, according to this aspect of the present invention, a vapor phase digester assembly is provided comprising the following components: A continuous digester having a top and a bottom, including a comminuted cellulosic fibrous material inlet at the top of the digester, and a pulp outlet at the bottom of the digester. At least one DOM-reducing screen assembly for withdrawing liquid having a first concentration of DOM, reducing the DOM concentration so that it is at a second concentration, much less than the first concentration, and then reintroducing the second DOM concentration liquid into the interior of the digester. A feed system for feeding a slurry of comminuted cellulosic fibrous material to the top of the digester, including a high pressure transfer device, a chip chute connected to the high pressure transfer device, a high pressure pump connected to the high pressure transfer device, circulatory conduits leading between the high pressure transfer device and the top of the digester, and a level tank operatively connected to the chip chute, and a means for removing liquor from the interior of the digester, this means providing for gross control of the level of liquid in the top of the digester to maintain a vapor phase at the very top of the digester. And, characteristic of the invention, means for effecting fine control of the level of liquid in the top of the digester to maintain a vapor phase at the very top of the digester, the means for effecting fine control comprising: a level control screen located below the liquid level adjacent the top of the vessel, but above other screens; a conduit leading from the level control screen and splitting into first and second branches the first branch recirculating liquid to the interior of the digester, and the second branch operatively connected to the level tank to facilitate fine control of the liquid level in the digester.

The assembly typically also includes means for cooling the liquid in the second branch between the digester and the level control tank, and a third branch branching off of the second branch, the third branch leading to recovery. Valve means may also be provided for controlling the relative amount of liquid flowing in the second and third branches.

A two vessel system may also be utilized, in which an impregnation vessel disposed between the high pressure transfer device and the digester in the circulatory conduits, and including a sluice conduit. In that case, the second branch is connected to the sluice conduit.

The invention also relates to a method of treating comminuted cellulosic fibrous material using this system, including a continuous digester having a top and a bottom, including a comminuted cellulosic fibrous material inlet at the top of the digester, and a pulp outlet at the bottom of the digester. The method comprises the following steps: At at least one location in the digester, effecting reduction of the DOM of the liquid in the digester by withdrawing liquid having a first concentration of DOM, reducing the DOM concentration so that it is at a second concentration, much less than the first concentration, and then reintroducing the second DOM concentration liquid into the interior of the digester. Feeding a slurry of comminuted cellulosic fibrous material to the top of the digester, including using a high pressure transfer device, a chip chute connected to the high pressure transfer device, a high pressure pump connected to the high pressure transfer device, circulatory conduits leading between the high pressure transfer device and the top of the digester, and a level tank operatively connected to the chip chute. Effecting gross level control of the level of liquid in the top of the digester to maintain a vapor phase at the very top of the digester; and effecting fine control of the level of liquid in the top of the digester to maintain a vapor phase at the very top of the digester, by withdrawing liquid from below the vapor phase at the top of the digester, but near the top of the vessel, splitting the withdrawn liquid into first and second branches, recirculating liquid in the first branch to the interior of the digester, and circulating liquid in the second branch to the level tank to facilitate fine control of the liquid level in the digester.

The method may also comprise the further step of cooling the liquid in the second branch between the digester and the level control tank. Where there is a third branch branching off of the second branch, here may be the further steps of leading the third branch to recovery, and controlling the relative amount of liquid flowing in the second and third branches.

According to another aspect of the invention, an extraction is taken from the outlet of the feed system make-up liquor pump. This allows the removal of DOM-rich liquor from the feed system (which is particularly advantageous since in means the DOM level at the beginning of the cook is less), while retaining fines or pin chips that may be present. The in-line drainer may be used with a single vessel or two vessel system, and with hydraulic or vapor phase digesters.

Also according to the present invention, it is important to design the extraction/dilution screens so as to minimize mixing between liquors of different DOM concentrations, while still also accommodating the direction of flow of chips and liquids in the vicinity of the screens. This is accomplished by providing first and second screens inside the digester, and at least one liquid re-introduction conduit for reintroducing liquid withdrawn through the extraction/dilution screens adjacent the volume of withdrawal, and having a liquid introducing opening therein. The first and second screens are vertically spaced from each other, the closest portions of the first and second screens spaced from each other a first distance. The liquid introducing opening in the re-introduction conduit is closest to the second screen and spaced from the closest portion of the second screen a second distance. The first distance is 0–10 feet (preferably about 4–6 feet), and the second distance is 0–10 feet (preferably about 3–6 feet). In countercurrent flow situations, the second screen is vertically above the first screen and the reintroduction conduit opening is above the second screen. In co-current flow situations, the second screen is vertically below the first screen and the reintroduction conduit opening is below the second screen.

Typically, one or both of the screens is connected to a flash tank through the withdrawal conduit, and at least one of the screens is connected to the reintroduction conduit. The digester also typically further comprising at least one screen assembly for withdrawing DOM rich liquid, splitting the liquid into first and second flows, passing the first flow to recovery; and adding low DOM liquid to the second flow, and reintroducing the second flow to the digester to reduce the concentration of DOM in the digester.

It is the primary object of the present invention to provide various systems and methods for enhancing the versatility and practicality of kraft pulping taking into account DOM, typically holding the DOM concentration below 100 g/l throughout the entire cook. This and other aspects of the invention will become clear from an inspection f the detailed description of the invention, and from the appended claims.

DETAILED DESCRIPTION OF THE DRAWINGS

Figure 1:
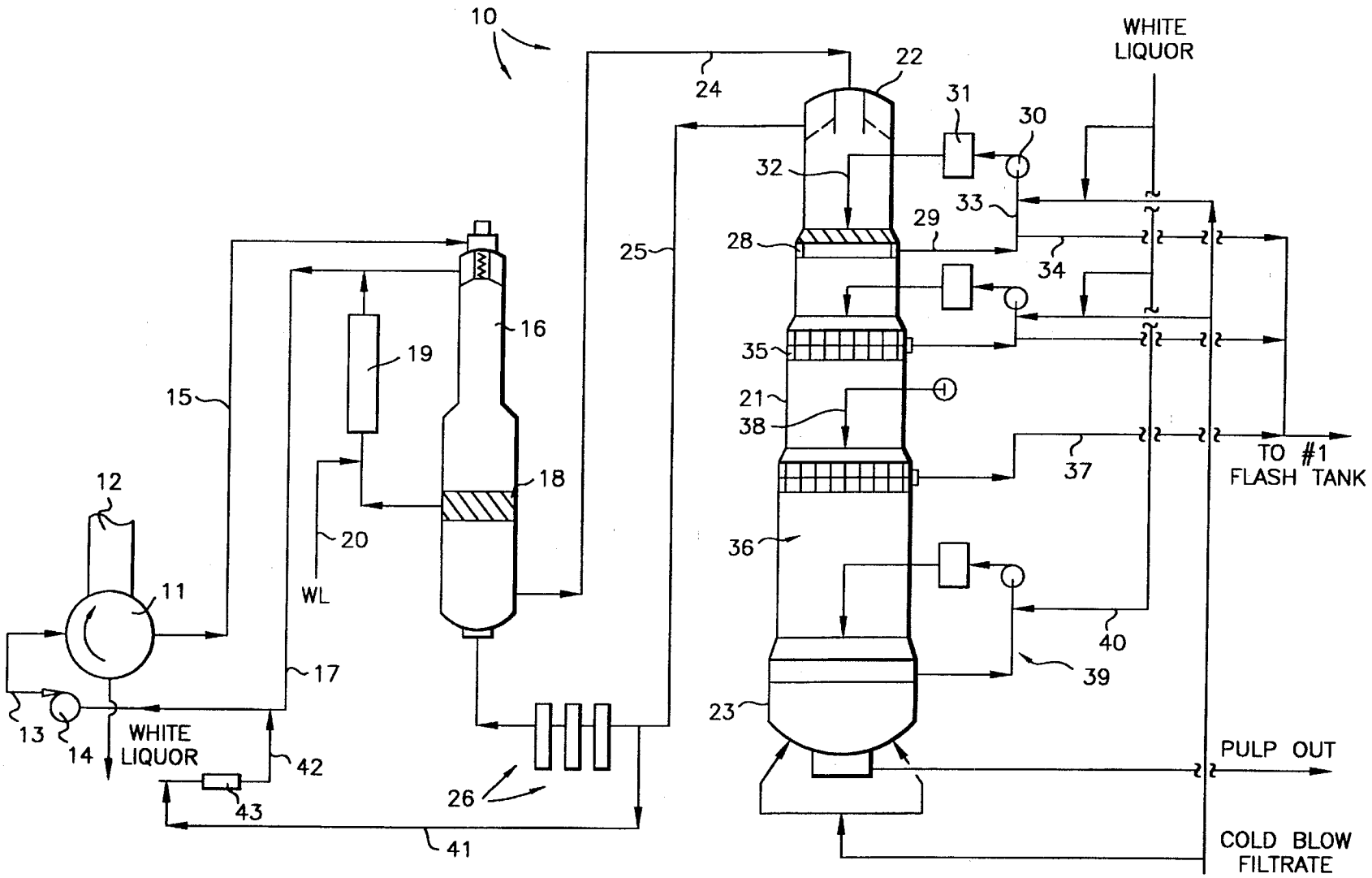
FIG. 1 is a schematic view of a first exemplary embodiment of a two vessel hydraulic or vapor phase digester system according to the invention for taking into account DOM while insuring proper liquid flow volume into the feed system.

FIG. 1 illustrates an exemplary two vessel hydraulic digester system 10 according to the invention, which includes a circulation to augment the flow to the feed system of the digester assembly. This aspect of the invention is equally applicable to a two vessel vapor phase system, however.

The system 10 includes a high pressure transfer device 11 connected to a chip chute 12 which feeds! chips (or other comminuted cellulosic fibrous material) to the low pressure input of the device 11, and the output 13 from a high pressure pump 14 is connected to the high pressure inlet of the device 11, the output from the device 11 including a first conduit 15 transporting slurry from the output of the device 11 to the top of an impregnation vessel 16, and the input to the pump 14 comprise a second conduit 17 which recirculates liquid separated from the slurry at the top of the vessel 16. The vessel 16 preferably includes a central screen 18 which withdraws liquid from the interior of the vessel 16 and passes it through a cooler 19 before feeding it to the second conduit 17; white liquor may be added in line 20 just before cooler 19.

The second vessel of the system 10 comprises the upright continuous digester 21 having a top 22 and bottom 23. Slurry from the bottom of impregnation vessel 16 passes in the first conduit 24 to the top 22, while the second conduit 25 returns liquid separated from the top 22 (through a conventional screen) to the bottom of vessel 16, typically through BC heaters 26.

In the digester 21, a plurality of withdrawals and recirculations are provided, to maintain the DOM concentration below 100 g/l throughout the cook. In the FIG. 1 embodiment, a trim screen assembly 28 is disposed adjacent the top 22, and includes a withdrawal conduit 29, pump 30, heater 31, and reintroduction conduit 32. The withdrawal conduit 29 includes a first branch 33 which is connected to the conduit 32, and a second branch 34 which goes to recovery (e.g. a flash tank), the branch 34 removing DOM-rich liquid from the digester. The liquid flow in branch 33 is augmented by low effective-DOM liquid, in the embodiment illustrated in FIG. 1 a Combination of cold blow filtrate and white liquor.

A cooking screen assembly 35 is disposed below screen assembly 28, having components comparable to those for assembly 28, and below the assembly 35 is an extraction screen 36 having a withdrawal conduit 37 leading to recovery (a flash tank), and a blanked recirculation pipe 38 is provided above the screen 36. The pipe 38 is provided so as to allow flexibility in the operation of the digester 21, allowing the screen 36 to be connected up as are the screens 28, 35 if desired. The wash circulation 39 is provided at the bottom f the vessel 21, and white liquor may be added thereto in line 40, in the practice of extended modified continuous cooking.

Using a system 10 as heretofore described about 45–60% of the white liquor is added to circulations in the digester 21, leaving an insufficient amount of liquid in the feed system, including the transfer device 11, for effective circulation and feeding, therefore, according to the invention, the flow in the circulatory system is augmented by withdrawing liquid from the conduit 25, in line 41, and passing it to the circulatory system, for example to the line 42 connected to the conduit 17. Since the temperature of the liquid in line 41 is high enough that it might cause flashing of some liquid in the device 11, and thus hammering, preferably the liquid passes through cooler 43. The cooler 43 may be an indirect heat exchanger, or an evaporative cooler. Preferably white liquor is added to the line 42 prior to the cooler 43, the amount of white liquor in lines 42 and 20 being about 40–55% of the total effective alkali needed for kraft cooking in the digester 21. The flow in line 17 may be augmented by withdrawal through screen 18 of vessel 16, as illustrated in FIG. 1.

Figure 2:
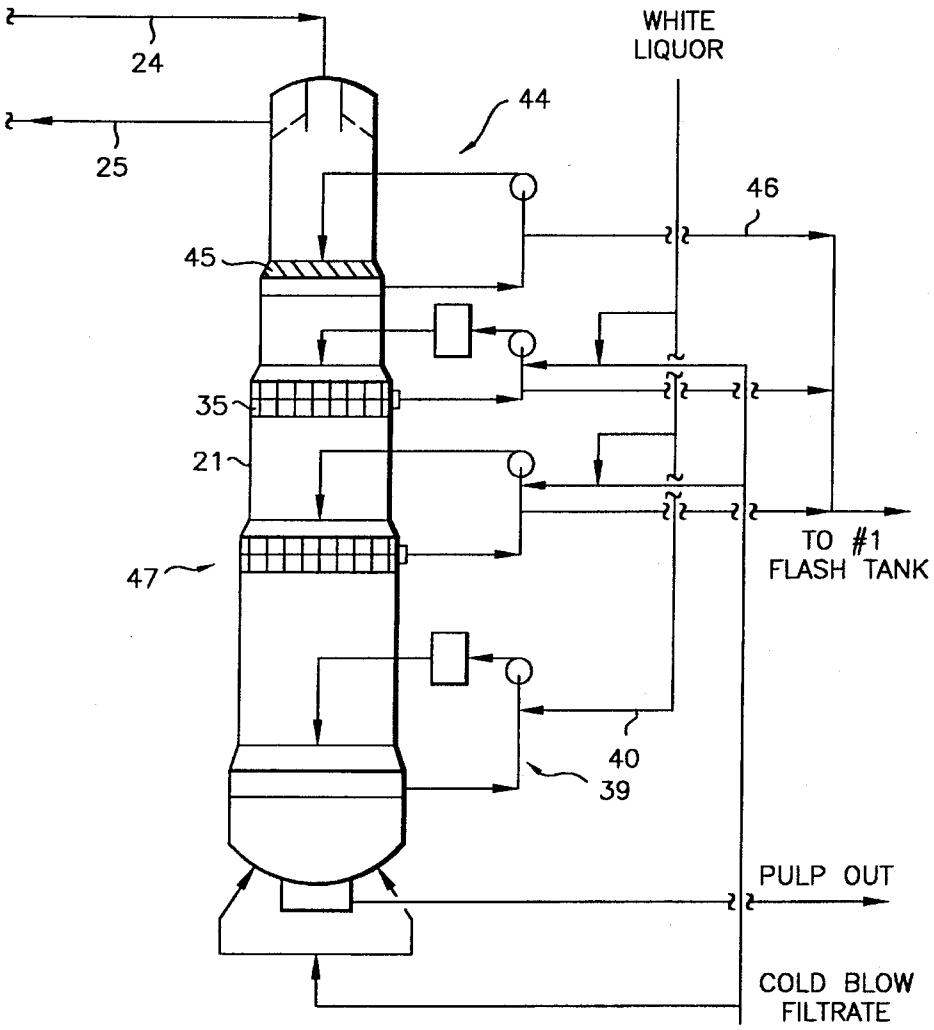
FIG. 2 is a view like that of FIG. 1 only with the feed system and impregnation vessel removed, and a modified form of digester circulations.

FIG. 2 shows an embodiment similar to that of FIG. 1 except for the particular circulations in the digester 21. In the FIG. 2 embodiment components the same as those in the FIG. 1 embodiment are indicated by the same reference numeral. In this embodiment, the top circulation 44 associated with top screen 45 has a branch conduit 46 through which some DOM-rich liquid is passed to recovery, while the other part is recirculated. The screen assembly 47 is between the assemblies 35, 39, which is like the screen assembly 28 (and components thereof) in the FIG. 1 embodiment. The impregnation vessel, line 41, cooler 43, and other components are the same in this embodiment as in the FIG. 1 embodiment.

Figure 3:
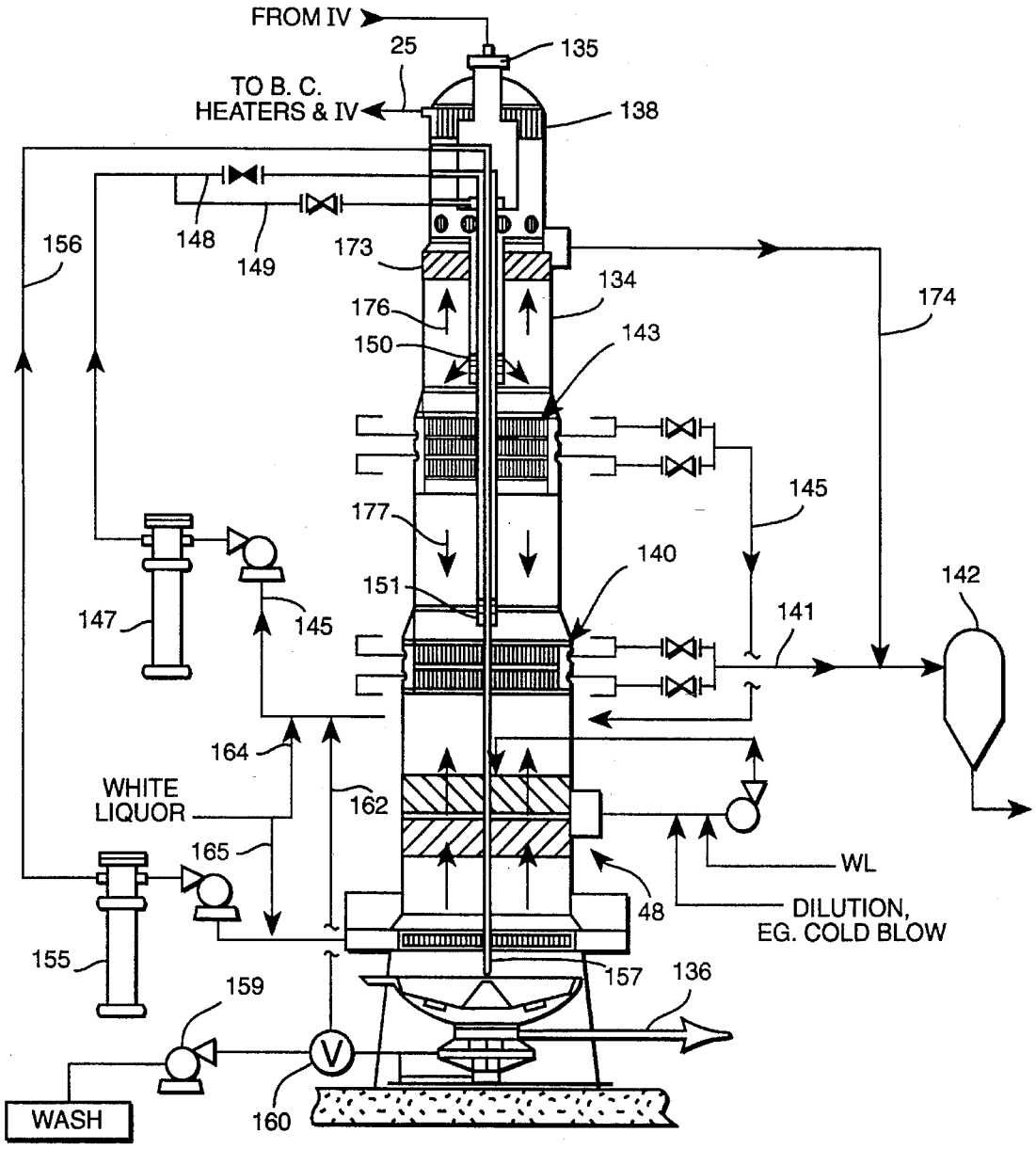
FIG. 3 is a schematic view like that of FIG. 2 only for another embodiment of digester.

FIG. 3 shows an embodiment of digester 11 identical to that shown in FIG. 18 of parent application Ser. No. 08/127,548, except that the line 25 thereof is connected to the impregnation vessel, line 41, cooler 43, and other components as in the FIGURE 1 embodiment, and an additional screen assembly 48. The liquid recirculated via assembly 48 has white liquid and low effective-DOM liquid added thereto before it is recirculated, providing a countercurrent washing zone, providing an additional level of DOM-reduced dilution to the wash zone.

Figure 4:
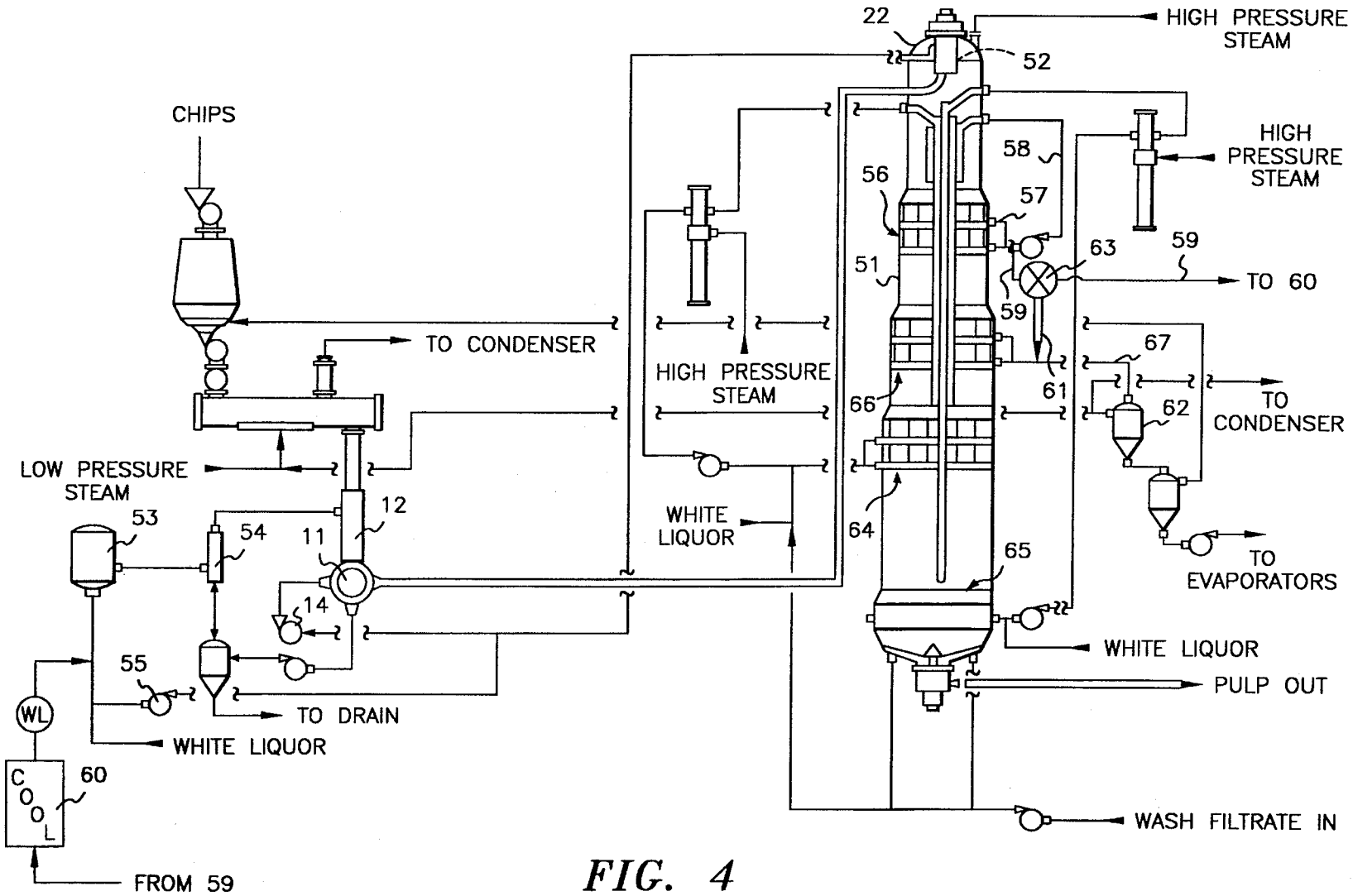
FIG. 4 is a view like that of FIG. 1 for a single vessel vapor phase digester system showing fine level control according to the invention.

In the embodiment of FIG. 4 a single vessel vapor phase digester system is illustrated generally by reference numeral 50, components in this embodiment comparable to those in the FIG. 1 embodiment shown by the same reference numerals. The digester 51 is a vapor phase digester, having a liquid level—illustrated schematically at 52 in FIG. 4—adjacent the top 22 thereof, with vapor (steam) above the level 52. Typically, the level 52 of the liquid adjacent the top of digester 51 is primarily controlled by an extraction flow through line 67 from extraction screen 66. The feed system of the digester system 50 in FIG. 4 includes the level tank 53, connected to an in-line drainer 54 (in turn connected to chip chute 12), a make-up liquor pump 55, and a source of white liquor.

While the extraction provided through line 67 provides good gross control of the level 52, according to the invention it is possible to provide fine level control, while at the same time providing DOM control through out the cook. This is accomplished using a level control screen 56 located below the level 52 (but the first screen assembly in the digester 51, above the other screens), a conduit 57 leading from the screen 56 and splitting into first and second branches 58, 59 respectively. The first branch 58 recirculates to the interior of the digester 51, while the second branch 59 is operatively connected to the level tank 53, preferably passing through a cooler 60 (like the cooler 43). Preferably a third branch 61 is also provided, which ultimately passes to flash tank 62 (recovery), and a valve means 63 may be provided at the junction between branches 59, 61 to control the relative amount of liquid flowing in the branches 59, 61 (i.e. to level tank 53, or to recovery 62).

The digester 51 also includes various other circulations, e.g. circulation 64, which is supplied with dilution liquid to reduce the effective DOM concentration in the digester 51, a wash circulation 65, and an extraction screen 66.

Figure 5:
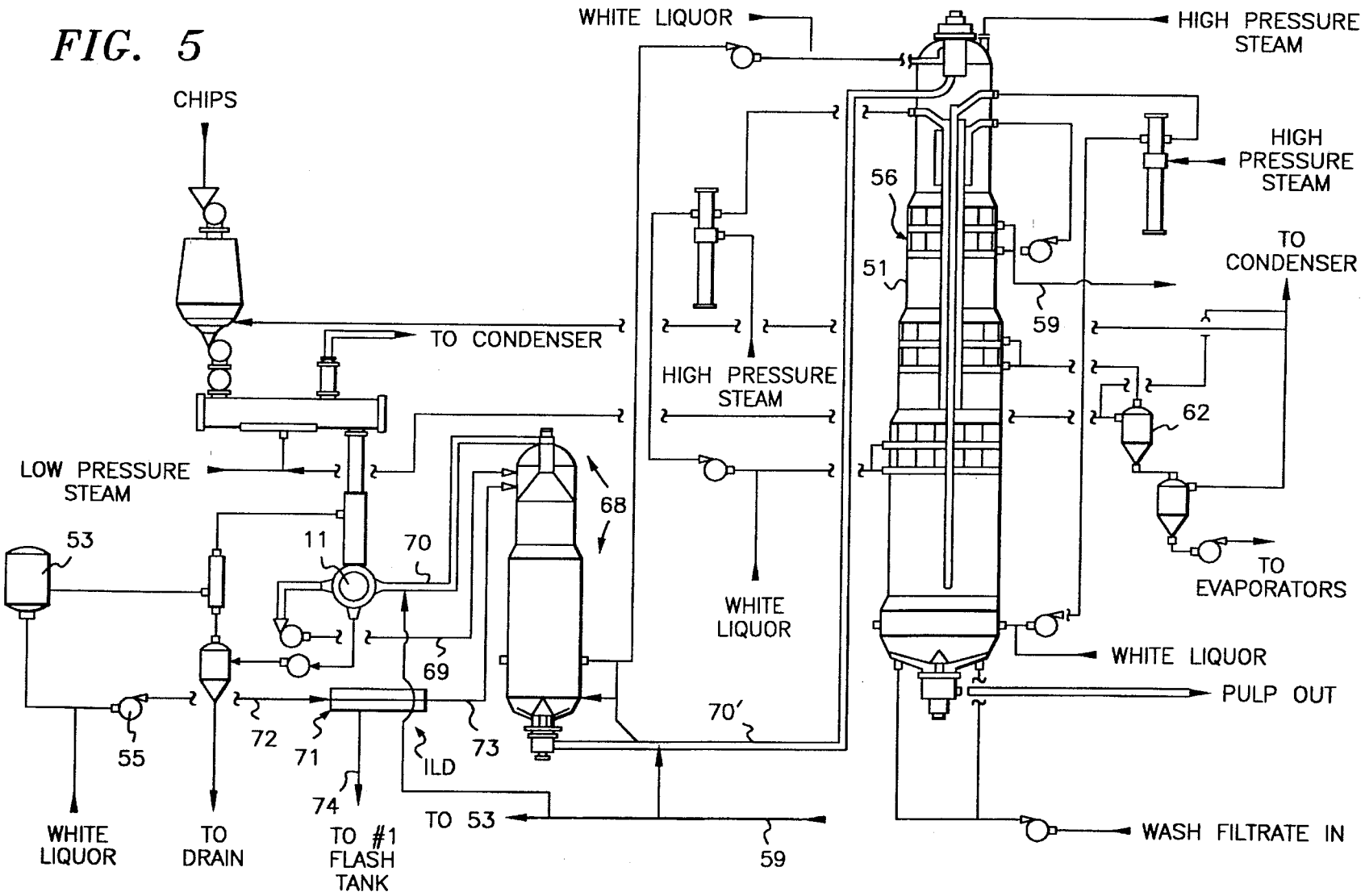
FIG. 5 is a view like that of FIG. 4 for a two vessel digester system, showing fine level control, and an in-line drainer in the feed system.

FIG. 5 illustrates an embodiment similar to that of FIGURE 4 except that a two vessel vapor phase system is provided, including an impregnation vessel 68, a recirculatory line 69 from the vessel 68 to the high pressure transfer device 11, and a flow line 70 from device 11 to the top of vessel 68, and a sluice flow line 70' is provided between the impregnation vessel 68 and digester 51. In this embodiment, the flow from line 59 preferably passes into the sluice flow line 70', although it can also lead to tank 53 or to line 70. FIG. 5 also shows other apparatus for controlling the level of DOM in the cooking process, including the conventional in-line drainer 71, an inlet line 72 thereto, and outlet line 73 therefrom, and a "drain" line 74 that passes DOM-rich liquid to flash tank 62. The inlet line 72 is preferably connected to the output from the make-up liquor pump 55. The line 73 is a liquid line connected to the top of the vessel 68.

Figure 6:
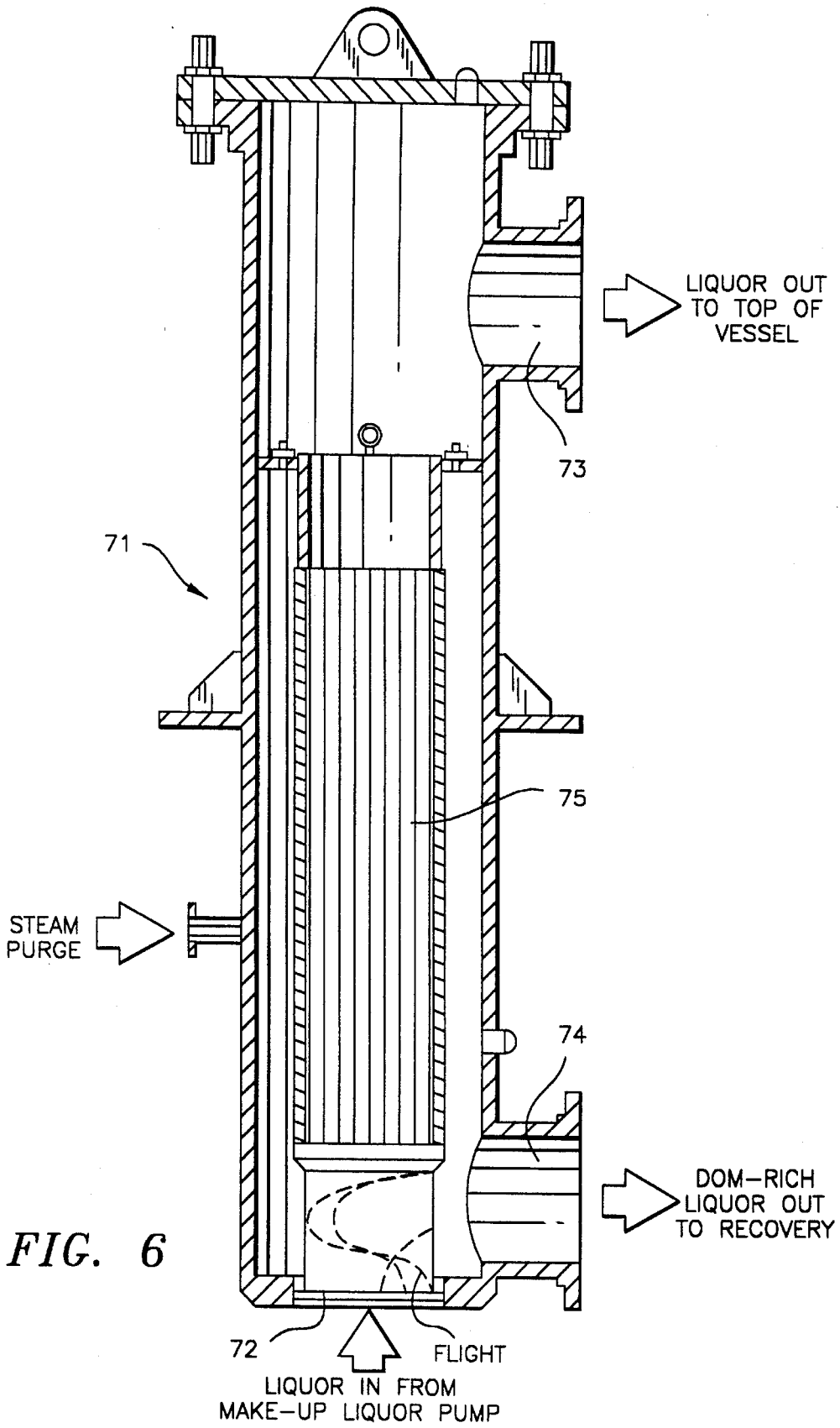
FIG. 6 is a longitudinal cross-sectional view of the in-line drainer of FIG. 5.

The in-line drainer 71 is conventional, and is illustrated in more detail in FIG. 6. It includes an interior screen 75, which is effective to separate out some of the DOM rich liquid that is introduced in line 72, but not fines or pin chips, which stay in the circulation through lines 72, 73.

Figure 8:
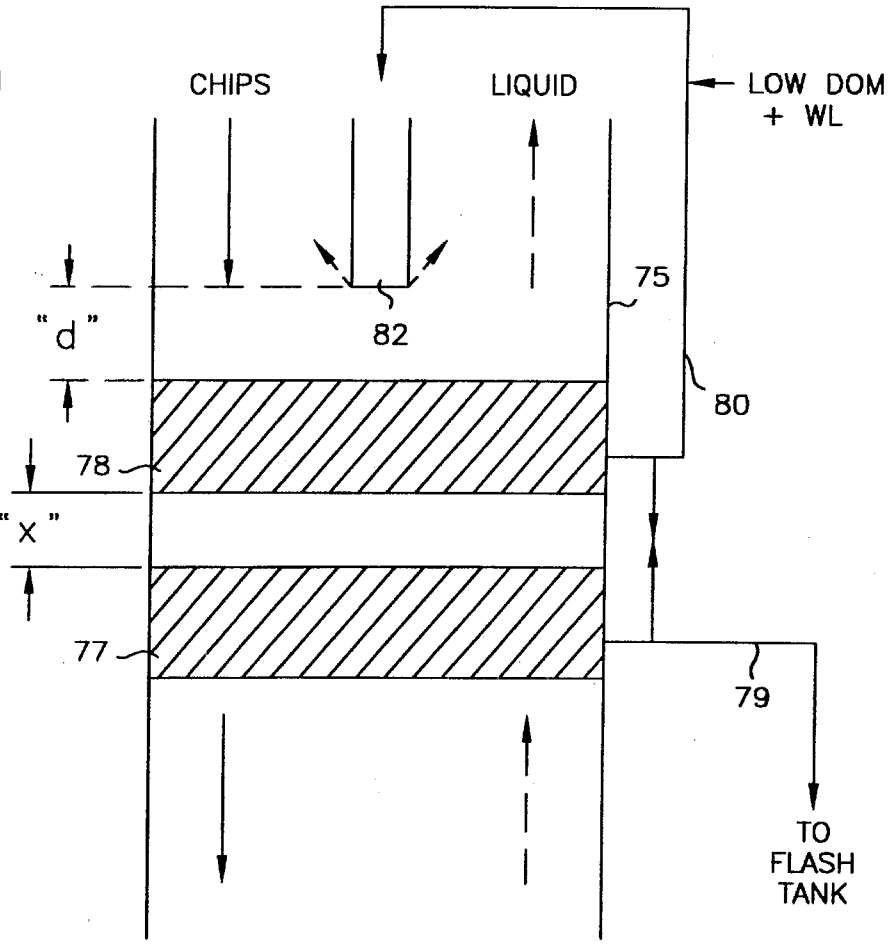
FIG. 8 is a view like that of FIG. 7 for an assembly where there is counter-current flow; and FIGS. *9a–9d* are schematic representations of single vessel digester systems having different arrangements of screens in order to permit optimization of the DOM concentration profile based upon furnish and desired pulp properties.

In utilizing apparatus, and practicing methods, in which DOM level is controlled during cooking, it is highly desirable to prevent mixing between streams of liquid having substantially different DOM levels. Significant efforts to prevent mixing of different streams has not been necessary in continuous digesters before, however since it is desired to control DOM levels according to the invention, it is highly desirable to minimize mixing. This is accomplished according to the invention using the screen assemblies illustrated in FIG. 7 and 8.

Figure 7:
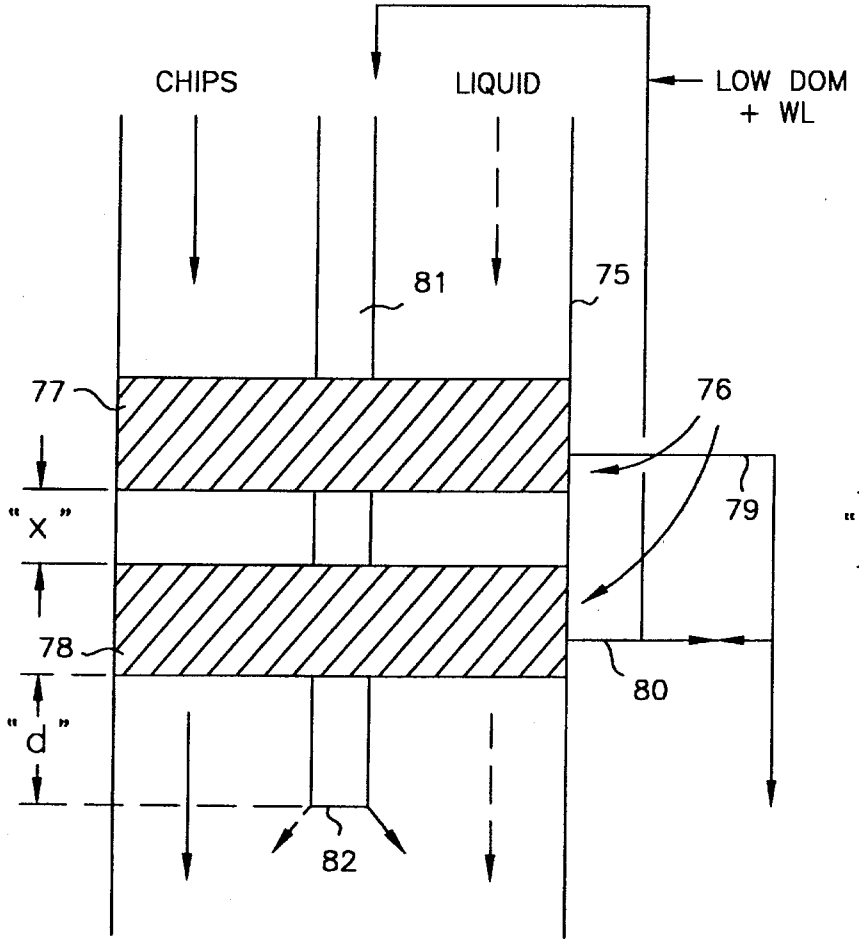
FIG. 7 is a schematic detail view of an arrangement of an extraction/dilution screen assembly according to the invention to minimize mixing of different DOM concentration liquids where there is co-current flow of the liquid and chips.

FIG. 7 schematically illustrates a digester 75 having at least one set of extraction/dilution screens 76, such as first screen 77 and second screen 78 vertically spaced from each other. The screens 77, 78 are between the top and bottom of the digester, typically at a central portion thereof. A first withdrawal line 79 extends from screen 77, and a second withdrawal line 80 extends from screen 78, withdrawing liquid from a withdrawal volume within the digester 75. At least one liquid re-introduction conduit 81 is provided for reintroducing liquid withdrawn from one of the screens 77, 78 (e.g. from line 80) into the digester 75 adjacent the volume of withdrawal. The conduit 81 has a liquid introducing opening 82 therein, typically at the bottom end thereof.

To minimize mixing of different DOM level liquids, the screens 77, 78 are spaced apart a first vertical distance X, which is dependent upon the species being cooked, the diameter of the digester 75, and numerous other variables. The distance X is within the range of 0–10 feet, preferably about 4–6 feet. Also to minimize mixing, the second distance (vertical spacing) "d" of the opening 82 from the closest portion of the second screen 78 is provided. The distance d is also highly dependent upon the variables of the cook and the digester, and is between 0–10 feet, typically about 3–6 feet.

FIG. 7 illustrates an embodiment in which there is cocurrent flow of the chips and liquid, the opening 82 being provided vertically below the second screen 78. In the FIG. 8 embodiment, countercurrent flow between liquid and chips is provided. In the FIG. 8 embodiment, all components are the same as in the FIG. 7 embodiment, except that the opening 82 is vertically above second screen 78 (which is above first screen 77 in this embodiment), and typically the exact connections of the withdrawal conduits 79, 80 are different, FIGS. 9*a*–9*d* schematically show other embodiments of single vessel hydraulic digesters according to the present invention which have various extraction and dilution locations providing great versatility to accommodate different materials being cooked, bleachability and strength requirements, etc. Each of the modifications in FIGS. 9*a*–9*d* is a modification of the basic construction illustrated in FIG. 20 of parent application Ser. No. 08/127,548 (the disclosure of which has been incorporated by reference herein).

Figures 9A, 9B, 9C, 9D:
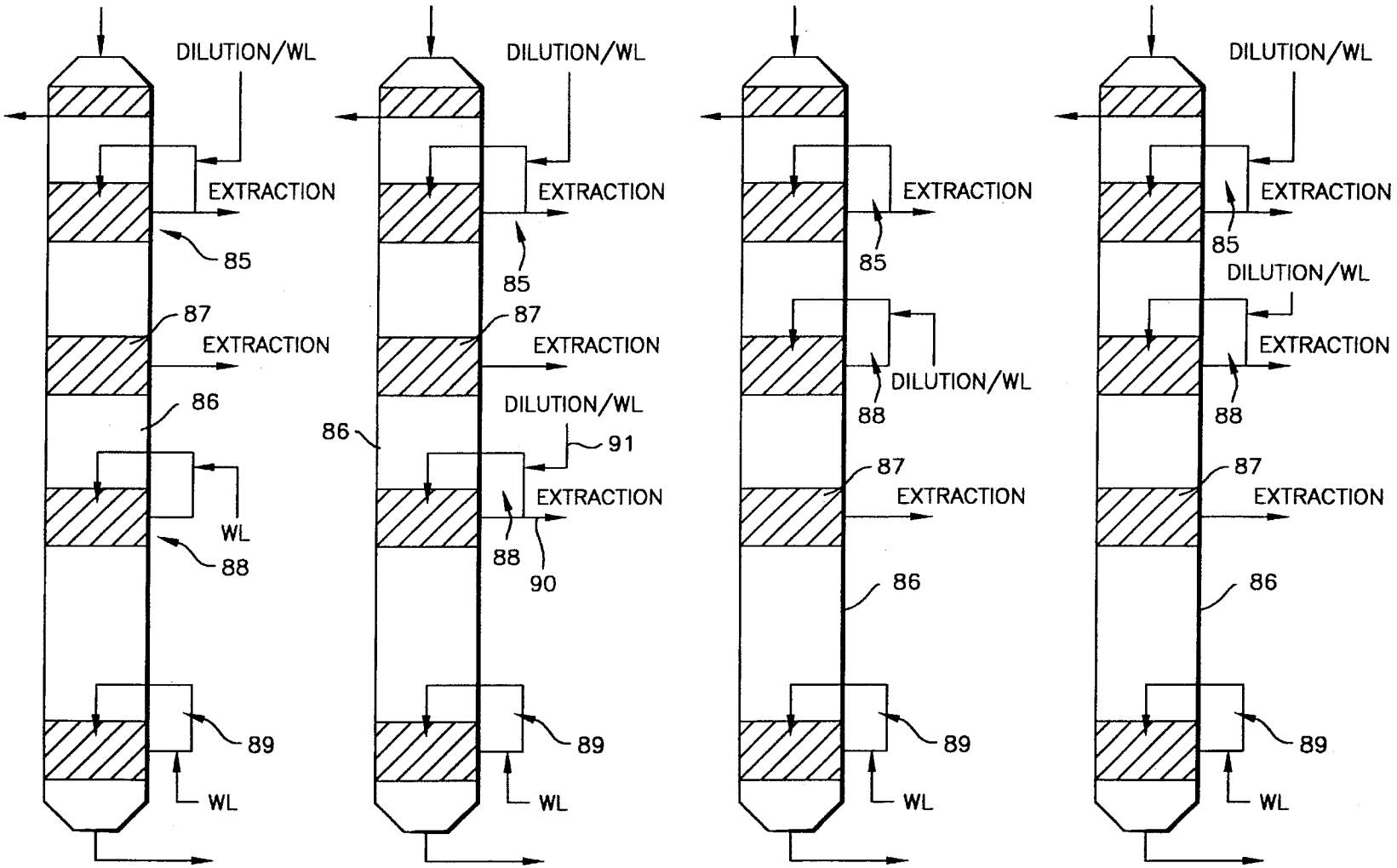

The basic difference between the FIG. 9*a* construction and that of FIG. 20 of the parent application is the use of a single cooking circulation 85 in the digester 86 instead of two cooking circulations. The FIG. 9*a* embodiment is for furnish that is easier to cook, for example hardwood, and is more economical that a two-circulation digester. An extraction screen 87 is below the cooking circulation 85, a modified continuous cooking circulation 88, with white liquor addition) is below that, and a wash circulation 89 with white liquor addition (for extended modified continuous cooking) in an EMCC® digester 86 adjacent the bottom. Although not see in FIG. 9*a* for simplicity's sake, each of the circulations 85, 88, and 89 includes a pump, indirect (steam) heater, and like conventional components. Two extractions are provided for the digester 86.

In the FIGS. 9*b*–*d* embodiments components similar to those in the FIG. 9*a* embodiment are shown by the same reference numeral.

The FIG. 9*b* embodiment is the same as that of FIG. 9*a* except that for the circulation 88 an additional extraction 90, with added dilution 91 to make up for what was extracted, is provided, to reduce DOM concentration further and/or in a more precisely controlled manner than in the FIG. 9*a* embodiment.

The FIG. 9*c* embodiment is the same as the FIG. 9*a* embodiment except that the extraction screen 87 is below the modified continuous cooking circulation 88, no dilution liquid is added to the cooking circulation 85, and dilution liquid is added with white liquor in the modified continuous cooking circulation 88. The FIG. 9*d* embodiment is identical to the FIG. 9*a* embodiment except that the extraction screen 87 and modified continuous cooking circulation 88 are simply switched, and dilution liquid is added to circulation 88.

The utilization of the alternative embodiments of FIGS. 9*a*–*d* allows optimization of the DOM concentration profile base upon furnish and desired pulp properties (e.g. strength or bleachability) in a single vessel system while providing improved energy economy compared to the embodiment of FIG. 20 of the parent application. While these embodiments are shown with a single vessel hydraulic digester 86, they may also be utilized with a single vessel vapor phase digester.

It will thus be seen that according to the present invention advantageous methods and systems are provided which are effective in providing practical and versatile control of the DOM level during kraft cooking. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation f the appended claims to encompass equivalent systems and processes.

What is claimed is:

1. A two vessel continuous digester system for digesting cellulosic fibrous material, including: an impregnation vessel having a top and a bottom, an inlet for cellulosic fibrous material slurry to be digested at the top of said impregnation vessel, and an outlet for slurry from the bottom of said impregnation vessel, and an outlet for recirculating liquid from the top of said impregnation vessel; a circulatory system for feeding slurry to the top of said impregnation vessel and receiving recirculating liquid from the top of said impregnation vessel; a continuous digester having a top and a bottom, an inlet for cellulosic fibrous material slurry to be digested at the top of the digester, an outlet for digested pulp at the bottom of the digester, and an outlet for recirculating liquid from the top of the digester; a first conduit extending between said impregnation vessel slurry outlet and said digester slurry inlet, and a second conduit extending between said recirculating liquid outlet at the top of said digester and the bottom of said impregnation vessel; at least one dissolved organic material-reducing screen assembly mounted on said digester and located between the top and bottom of said digester; means for withdrawing a first portion of the liquid passing through said at least one dissolved organic material-reducing screen assembly and passing said first portion of the liquid to a recovery system, a second portion of the liquid remaining; means for adding low dissolved organic material liquid aside from cooking liquor to said second portion to provide an augmented second portion; means for adding cooking liquor to said second portion means for recirculating said augmented second portions to the interior of said digester; and means for augmenting the flow of liquid in said circulatory system, comprising means for withdrawing liquid from said second conduit, means for cooling the withdrawn liquid, and means for introducing the cooled withdrawn liquid into said circulatory system.

2. A system as recited in claim 1 wherein said circulatory system includes a high pressure transfer device and a high pressure pump having an inlet and an outlet, said high pressure transfer device being connected to said high pressure pump outlet; and wherein said means for introducing the cooled withdrawn liquid into said circulatory system comprises means for introducing the cooled withdrawn liquid into a conduit connected to said high pressure pump inlet.

3. A system as recited in claim 2 further comprising means for adding cooking liquor to the withdrawn liquid from the second conduit.

4. A system as recited in claim 3 wherein said means for adding cooking liquor to the withdrawn liquid adds the cooking liquor before said means for cooling the withdrawn liquid.

5. A system as recited in claim 1 wherein said means for cooling the withdrawn liquid comprises a heat exchanger cooler, or an evaporative cooler.

6. A system as recited in claim 1 wherein said digester further includes an extraction screen assembly; and wherein said at least one dissolved organic material assembly reducing screen comprise a trim screen assembly located adjacent the top of said digester, and a cooking screen assembly disposed between said trim screen assembly and said extraction screen assembly.

7. A system as recited in claim 6 wherein said digester further includes a wash screen assembly located between the bottom of said digester and said extraction screen assembly, and further comprising means for adding cooking liquor to said wash screen assembly.

8. A system as recited in claim 6 further comprising a blanked recirculation pipe disposed in said digester at said extraction screen assembly, so that said extraction screen assembly may be readily modified to comprise a recirculating screen assembly.

9. A system as recited in claim 1 wherein said digester further includes a combined recirculating and extraction screen assembly adjacent the top of said digester; and wherein said at least one dissolved organic material reducing screen assembly include a first screen assembly disposed below said combined recirculating and extraction screen assembly, and a second screen assembly disposed below said first screen assembly.

10. A system as recited in claim 9 wherein said digester further includes a wash screen assembly located between the bottom of said digester and said second screen assembly, and further comprising means for adding cooking liquor to said wash screen assembly.

11. A system as recited in claim 1 wherein said digester further includes a combined recirculating and extraction screen assembly adjacent the top of said digester, and a wash screen assembly located adjacent the bottom of said digester; and an extraction screen assembly located above said wash screen assembly.

12. A system as recited in claim 11 wherein said at least one dissolved organic material reducing screen assembly comprises a first screen assembly between said combined recirculating and extraction screen assembly and said extraction screen assembly.

13. A system as recited in claim 12 wherein said at least one dissolved organic material reducing screen assembly further comprises a second screen assembly between said extraction screen assembly and said wash screen assembly.

* * * * *